United States Patent [19]

Allina

[11] Patent Number: 4,944,692

[45] Date of Patent: Jul. 31, 1990

[54] ELECTRICAL PLUG-IN CONNECTORS

[76] Inventor: Edward F. Allina, 605 Capri Blvd., Treasure Island, Fla. 33706

[21] Appl. No.: 315,559

[22] Filed: Feb. 24, 1989

[51] Int. Cl.[5] ..... H01R 33/945

[52] U.S. Cl. ..... 439/517; 439/913; 439/845; 439/858; 29/854

[58] Field of Search ..... 439/167, 508, 913, 839, 439/833, 845, 849, 850, 858, 517, 856, 620; 29/854

[56] References Cited

U.S. PATENT DOCUMENTS

| | | | |
|---|---|---|---|
| 1,953,807 | 4/1934 | Jackson et al. | 439/833 |
| 2,452,019 | 10/1948 | Rowe | 439/833 |
| 2,709,793 | 5/1955 | Johansson | 437/845 |
| 2,980,882 | 4/1961 | Davis, III | 439/517 |
| 3,423,723 | 1/1969 | Kobryner | 439/858 |
| 4,699,445 | 10/1987 | Porta et al. | 439/620 |
| 4,776,706 | 10/1988 | Loiterman et al. | 439/620 |

*Primary Examiner*—David L. Pirlot
*Attorney, Agent, or Firm*—Charles A. McClure

[57] ABSTRACT

Electrical plug-in connectors with modified jaws to receive a conducting blade therebetween. Electrical connection is improved by increasing the curvature radius of a generally S-shaped contacting jaw's free end and/or its spring bias toward a cooperating rigid jaw end, and by providing a flat contacting surface on the face of such free end to parallel a flat contacting surface on the rigid jaw end.

8 Claims, 1 Drawing Sheet

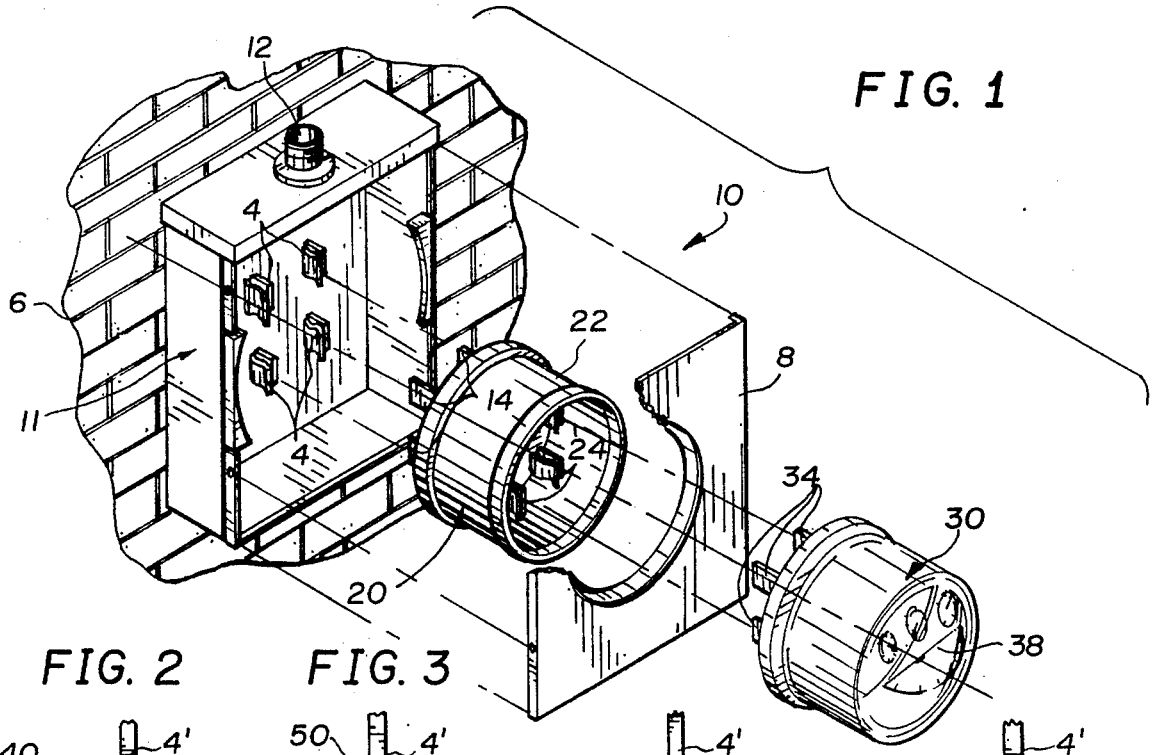
FIG. 1
FIG. 2
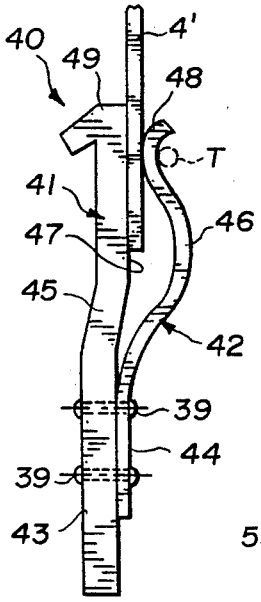
(PRIOR ART)
FIG. 3
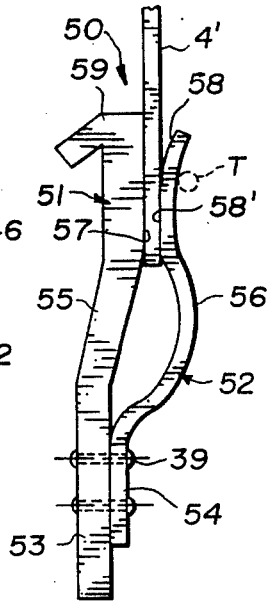
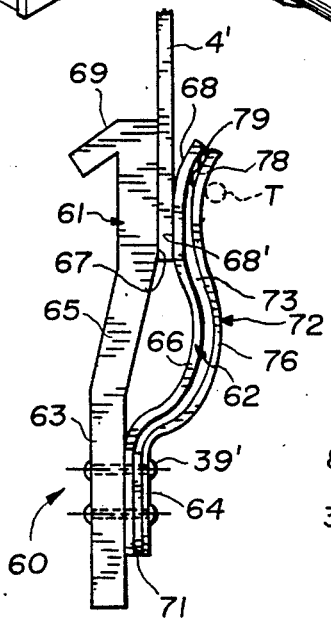
FIG. 4
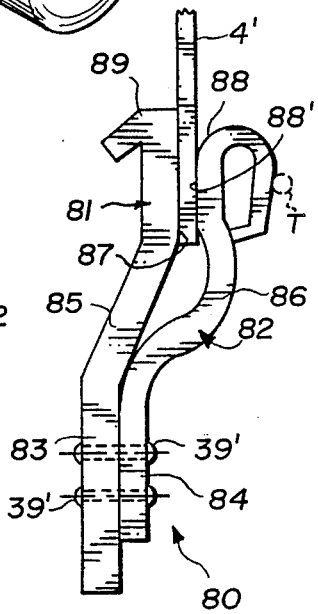
FIG. 5
FIG. 6
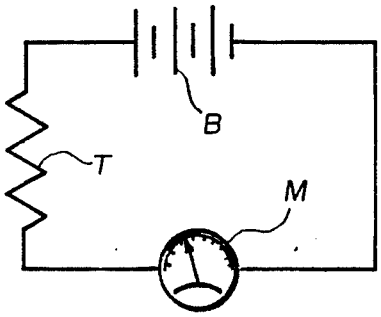

ELECTRICAL PLUG-IN CONNECTORS

TECHNICAL FIELD

This invention relates to electrical plug-in connectors, featuring conductive socket jaws into which straight blade or spade terminals slide to establish electrical connections, such as in or with watt-hour meters or other plug-in apparatus.

BACKGROUND OF THE INVENTION

Nearly every household provided with electrical service has, at an entryway for electrical service, a watt-hour meter for monitoring the consumption of electrical energy in the household. A principal requirement there is positive electrical contact between the meter and its socket, which may be located in a service panel or may be in a plug-in type of adapter between such a meter and such a panel.

Straight blade or spade terminals protruding from the base of the meter housing slidably engage socket jaws within such a panel or adapter. The jaws occur in individual pairs spring-biased together to ensure a good electrical contact with an intervening blade. Such bias is often provided by means of the configuration or the material of one or both jaws in a pair, but the need to conduct electricity very well limits the available materials. A customary arrangement combines a heavy relatively rigid jaw having a flat blade-receiving surface and a lighter S-curved jaw having one convex side pressing against such flat rigid surface of the cooperating jaw. However, as the curved contacting surface is quite limited in extent, a hot spot tends to develop there, to the detriment of the spring-bias and the electrical conduction. Improved plug-in connectors with cooperating jaws are needed, and my invention meets that need.

SUMMARY OF THE INVENTION

In general, the objects of the present invention are attained, in a conductive jaw pair adapted to receive a straight conductive blade therebetween, by modifying the configuration of the S-curved jaw to increase its radius of curvature at its locus of contact with the flat jaw and/or to increase its spring bias. The radius may be increased drastically by flattening one side of a backhook or eye, and the bias increased by means of an auxiliary spring, for example.

A primary object of this invention is to provide improved configurations of jaw blades to receive straight electrical connectors slidably between the respective jaws in a cooperating jaw pair.

Another object of the invention is to improve the spring bias pressing a pair of such electrically conductive jaws together.

A further object of the invention is to enhance the currentcarrying capacity of such jaw blades.

Other objects of the present invention, together with means and methods for attaining the various objects, will be apparent from the following description and the accompanying illustration of one or more preferred embodiments thereof, presented by way of example rather than limitation.

SUMMARY OF THE DRAWINGS

FIG. 1 is an exploded perspective view of a watt-hour meter with straight blade connectors aligned with socket jaws of a meter adapter whose own blade connectors are adapted to engage complementary socket jaws of an electrical panel;

FIG. 2 is a side elevation of socket jaws of the prior art, with a blade terminal engaged and a temperature sensor juxtaposed;

FIG. 3 is a side elevation of a first embodiment of socket jaws according to the present invention;

FIG. 4 is a similar view of a further embodiment of socket jaws according to this invention;

FIG. 5 is a like view of yet another jaws embodiment according to the invention; and FIG. 6 is a schematic diagram of temperature-sensing equipment including a sensor juxtaposed to the prior art embodiment of FIG. 2.

DETAILED DESCRIPTION

FIG. 1 shows, in horizontally exploded perspective, electrical apparatus 10 featuring panel 11 rear-mounted on brick wall 6 and having open fitting 12 at its top to admit external electrical power input leads (not shown). The panel supports a quartet of conducting jaws 4 in socket configuration inside, at least the upper pair being connected to the input leads. The panel is uncovered at the front to receive in the socket jaws a complementary set of blades 14 protruding from the far side of cylindrical housing 22 of meter adapter 20. Cover 8 (shown partly cut away) fits about the adapter housing—and covers the front of the panel—just as it fit about a watt-hour meter in the absence of an adapter. Adapter jaws 24 are visible in like socket configuration on its near side in position to receive blades 34 protruding from the far side of watt-hour meter 30, which has customary transparent face 38 within which some of the meter mechanism is visible. The meter fits over and closes off the adapter housing in assembled configuration. In the optional absence of the meter adapter, the meter blades plug directly into the panel socket jaws in like manner as the blades of the adapter (when present) plug thereinto and as the meter blades then plug into the adapter jaws. Regardless of which configuration is present, the conventional jaws thereof shown in the next view are subject to disadvantages in comparison with those of this invention.

FIG. 2 shows, in side elevation, conventional blade-and-socket embodiment 40 of plug-in electrical connectors, having left jaw 41 and right jaw 42. The left jaw has straight base 43, intermediate angled offset portion 45, flat face 47 on its free end portion, which ends in hook 49. Thinner relatively flexible and resilient right jaw 42 has straight base portion 44 fastened to base 43 of the left jaw by rivets 39. The right jaw has an S-curve configuration, with intermediate portion 46 curving convexly to the right, and then smaller leftward oriented convex end face portion 48. The radius of curvature (not separately marked) of the latter convex portion is appreciably less than the oppositely directed curvature radius of the intermediate curved portion. An end of separate blade 4' is shown between and contiguous with flat face 47 of the left jaw and convex face 48 of the right jaw. At the concave outer surface of the curved end portion is a small circle (in broken lines) designated T to suggest that it is an occasional site for a conventional temperature-sensing thermistor, discussed further below.

FIG. 3 shows first embodiment 50 of apparatus of the present invention, having relatively rigid (and thick) jaw 51 and thinner relatively resilient jaw 52. The rigid jaw at the left comprises straight base 53, intermediate angled offset portion 55, and flat face 57 on its free end portion, which ends in hook 59. Right jaw 52 has straight base portion 54 fastened to base 53 of the left jaw by rivets 39. The right jaw has an S-curve configuration, with intermediate portion 56 curving convexly to the right, and then free end portion 58 curving convexly to the left. The curvature radius of the latter convex portion is appreciably greater than the curvature radius of the intermediate curved portion. The convex portion of the free end has flat face 58, substantially parallel to flat face 57 of jaw 51, and the free end of blade 4, is shown in between and contiguous with both such flat faces. As in FIG. 2 (prior art), the concave outer surface of this more gradually curved end portion 58 is an occasional location for thermistor T (in broken lines).

FIG. 4 shows second embodiment 60 of apparatus of this invention, having relatively rigid jaw 61 and relatively flexible jaw 62, superficially similar to the jaws of the previous embodiment. The rigid jaw at the left comprises straight base 63, intermediate angled offset portion 65, and flat face 67 on its free end portion, which ends in hook 61. Right jaw 62 has straight base portion 64 fastened to base 63 of the left jaw by rivets 39' (so designated because of an increased length requirement). The right jaw has an S-curve configuration, with intermediate portion 56 curving convexly to the right, and then smaller free end portion 58 curving convexly to the left with flat face 68' thereon substantially parallel to flat face 67 of the left jaw, with the free end of blade 4' in between and contiguous with both such faces.

Also fastened at the base of FIG. 4 embodiment 60, by longer rivets 39', are spacer 71 and helper spring 72. The helper spring follows generally the curvature of right jaw 62 but is spaced apart by intervening air gap 73 from the jaw throughout intermediate curve 72 and most of curved end portion 78. Near the free end of the helper spring are convex bosses 79 in point contact with the concave surface of curved end portion 68. Occasional thermistor T lies at the concave outer surface of end 78 of helper spring 72.

FIG. 5 shows third embodiment 80 of apparatus of this invention, having relatively rigid jaw 81 and nearly as thick relatively resilient jaw 82. The rigid jaw at the left comprises straight base 83, intermediate angled offset portion 85, and flat face 87 on its free end portion, which ends in hook 89. Right jaw 82 has straight base portion 84 fastened to base 83 of the left jaw by rivets 39'. The right jaw has an S-curve configuration, with intermediate portion 86 curving convexly to the right, and then looped free end portion 88 curving first to the left and then all the way around to the right to terminate at its outside surface so as to close the loop. Flat face 88' is on the left side of the loop substantially parallel to flat face 87 of the left jaw, with the free end of blade 4' between and contiguous with both such faces. In this embodiment, occasional thermistor T is located against the surface of end loop 88 most remote from flat face 87 of the other jaw.

FIG. 6 shows schematically a simple electrical circuit for the measurement or monitoring of temperature. Featured are battery B at the top, meter M at the bottom, and thermistor T at one side, all in series circuit. The electrical resistance of the thermistor varies with change in ambient temperature, altering the flow of current through the meter, thereby relocating the pointer along its scale. It will be understood that such a thermistor is usually located in line with a perpendicular to the flat face of the first jaw drawn through a point of contact (or of closest approach) of the second jaw thereto, and against the nearby outer surface of the latter jaw, as shown in FIG. 2. Similar locations, shown in FIGS. 3 through 5, are suitable for sensing the temperature of the embodiments of this invention illustrated in those views. In the last embodiment the thermistor alternatively could be placed where the end of the loop abuts the intermediate portion of the looped jaw. In any event the meter shows the temperature at the selected location, as an index of the performance of the plug-in connector apparatus. Performance can be monitored throughout an appreciable time period by recording the readings. As the jaws of the connectors of the present invention make better contact with an inserted blade, temperature measurements so made upon them reveal lower temperatures at a given current flow, or greater current flow possible at a given temperature.

Accordingly, plug-in connectors with jaws as prescribed herein retain their biasing resiliency better, which in turn improves the current/temperature relationship. The same advantage accrues where a helper spring is also present, as the composition (usually steel) of such a spring starts out more resilient than the composition of the jaws (almost invariably copper). In gauge and/or temper, jaws so aided can then favor flexibility more than resiliency—needed for unaided biasing. Regardless of which embodiment is preferred, its structure and operation will exceed what the prior art has provided.

Various embodiments of the present invention have been shown and described, somewhat similar to one another but also evidencing individual differences. Other modifications can be made, as by adding, combining, deleting, or subdividing parts or steps, retaining at least some of the advantages and benefits of the invention—which itself is defined in the following claims.

I claim:

1. Electrical plug-in connector apparatus, comprising adjacent first and second electrically conductive jaws oriented generally parallel to one another, and fastened together near one end of each, and biased together near their opposite or free ends;

the first jaw being relatively rigid and having a substantially flat face near its free end adjacent the free end of the second jaw, the second jaw being S-curved, relatively flexible and having a convex portion near its free end with a substantially flat face adjacent the flat face of the first jaw;

a similarly curved biasing spring fastened to the second jaw and extending along but spaced from the side of the second jaw most remote from the first jaw to the free end of the second jaw, where the free end of the biasing spring becomes contiguous with the second jaw and is thereby adapted to bias its flat face toward the other flat face;

the jaws being so adapted to receive a substantially straight conductive blade in contact therewith between such free ends.

2. Plug-in connector apparatus according to claim 1, including also means so fastening the jaws together.

3. Plug-in connector apparatus according to claim 1, including also such a conductive blade so engageable between such flat faces of the respective jaws.

4. Method of using the plug-in connector apparatus of claim 1, comprising slidably engaging such a conductive blade between such free ends of the respective jaws and into contact with such flat faces of both jaws.

5. Method of measuring the temperature of electrical plug-in connector apparatus comprising adjacent first and second electrically conductive jaws having respective captive and free ends, the first jaw being relatively rigid and having a substantially flat face near its free end adjacent the free end of the second jaw, the second jaw being relatively resilient and having a convex portion near its free end with a substantially flat face adjacent the flat face of the first jaw, and also having an intermediate portion curved to bias such convex portion toward such flat face, the jaws being so adapted to receive a substantially straight conductive blade in contact therewith between such flat faces;

including the steps of slidably engaging such a conductive blade between such free ends of the respective jaws and into contact with such flat faces of both jaws, and, with such conductive blade in place, locating a temperature sensor adjacent the outermost surface of the second jaw along an intersection of a line projected substantially perpendicularly from such flat face of the first jaw through such blade and through the flat face of the second jaw and past the second jaw to such location.

6. Method of measuring the temperature of electrical plug-in connector apparatus comprising adjacent first and second electrically conductive jaws oriented generally parallel to one another, fastened together near one end of each, and biased together near their opposite or free ends;

the first jaw being relatively rigid and having a substantially flat face near its free end adjacent the free end of the second jaw, the second jaw being relatively resilient and having a convex portion near its free end with a substantially flat face adjacent the flat face of the first jaw, and also having an intermediate portion more curved than such convex face and adapted to bias such substantially flat face of the convex portion toward such flat face;

the jaws being so adapted to receive a substantially straight conductive blade in contact therewith between such flat faces;

including the steps of slidably engaging such a conductive blade between such free ends of the respective jaws and into contact with such flat faces of both jaws, and, with such conductive blade in place, locating a temperature sensor adjacent the outermost surface of the second jaw along an intersection of a line projected substantially perpendicularly from such flat face of the first jaw through such blade and through the flat face of the second jaw and past the second jaw to such location.

7. Method of measuring the temperature of electrical plug-in connector apparatus comprising adjacent first and second electrically conductive jaws oriented generally parallel to one another, and fastened together near one end of each, and biased together near their opposite or free ends;

the first jaw being relatively rigid and having a substantially flat face near its free end adjacent the free end of the second jaw, the second jaw being relatively resilient and having a closed loop near its free end with a flat face adjacent the flat face of the first jaw, and also having an intermediate portion curved to bias such such flat face toward the flat face of the first jaw;

the jaws being so adapted to receive a substantially straight conductive blade in contact therewith between such free ends;

including the steps of slidably engaging such a conductive blade between such free ends of the respective jaws and into contact with such flat faces of both jaws, and, with such conductive blade in place, locating a temperature sensor adjacent the outermost surface of the second jaw along an intersection of a line projected substantially perpendicularly from such flat face of the first jaw through such blade and through the flat face of the second jaw and past the second jaw to such location.

8. Method of measuring the temperature of electrical plug-in connector apparatus comprising adjacent first and second electrically conductive jaws oriented generally parallel to one another, and fastened together near one end of each, and biased together near their opposite or free ends;

the first jaw being relatively rigid and having a substantially flat face near its free end adjacent the free end of the second jaw, the second jaw being relatively flexible and having a convex portion near its free end with a substantially flat face adjacent the flat face of the first jaw;

a biasing spring fastened to the second jaw and extending along but spaced from the side of the second jaw most remote from the first jaw to the free end of the second jaw, where the free end of the biasing spring becomes contiguous with the second jaw and is thereby adapted to bias its flat face toward the other flat face;

the jaws being so adapted to receive a substantially straight conductive blade in contact therewith between such free ends;

including the steps of slidably engaging such a conductive blade between such free ends of the respective jaws and into contact with such flat faces of both jaws, and, with such conductive blade in place, locating a temperature sensor adjacent the outermost surface of the second jaw along an intersection of a line projected substantially perpendicularly from such flat face of the first jaw through such blade and through the flat face of the second jaw and past the second jaw to such location.

* * * * *